US007055489B2

(12) United States Patent
Kurokawa et al.

(10) Patent No.: US 7,055,489 B2
(45) Date of Patent: Jun. 6, 2006

(54) ENGINE UNIT CASE

(75) Inventors: Hiroyuki Kurokawa, Aichi-ken (JP); Fumiyuki Suzuki, Nagoya (JP); Shoji Kobiyama, Nagoya (JP)

(73) Assignees: Aisin Seiki Kabushiki Kaisha, Aichi-ken (JP); Aichi Machine Industry Co., Ltd., Aichi-ken (JP)

( * ) Notice: Subject to any disclaimer, the term of this patent is extended or adjusted under 35 U.S.C. 154(b) by 0 days.

(21) Appl. No.: 10/964,719

(22) Filed: Oct. 15, 2004

(65) Prior Publication Data

US 2005/0081816 A1 Apr. 21, 2005

(30) Foreign Application Priority Data

Oct. 21, 2003 (JP) ..... 2003-361014

(51) Int. Cl.
*F01M 1/16* (2006.01)
*F04B 49/00* (2006.01)
*F16N 7/14* (2006.01)

(52) U.S. Cl. ..... 123/196 R; 417/310; 184/26

(58) Field of Classification Search ..... 123/196 R, 123/196 CP, 196 C; 417/310; 184/26, 27.1, 184/27.3, 28, 15, 6.5
See application file for complete search history.

(56) References Cited

U.S. PATENT DOCUMENTS

| | | | | |
|---|---|---|---|---|
| 3,443,522 | A | 5/1969 | Schindler | 417/283 |
| 4,683,659 | A * | 8/1987 | Wunsch et al. | 184/15.1 |
| 4,976,595 | A | 12/1990 | Taniguchi | 418/171 |
| 5,085,187 | A | 2/1992 | Black | 123/196 R |
| 5,857,442 | A | 1/1999 | Sumi | 123/196 R |
| 6,267,566 | B1 | 7/2001 | Konishi et al. | 417/310 |
| 6,352,085 | B1 | 3/2002 | Morita et al. | 137/516.2 |

FOREIGN PATENT DOCUMENTS

| | | |
|---|---|---|
| JP | 8-484 | 4/1990 |
| JP | 5-10721 | 7/1991 |
| JP | 10-141039 | 11/1996 |

OTHER PUBLICATIONS

"Neue Ideen und komplette Serienentwicklungen" (in German).
European Search Report dated Apr. 4, 2005.

* cited by examiner

*Primary Examiner*—Willis R. Wolfe, Jr.
(74) *Attorney, Agent, or Firm*—Reed Smith LLP; Stanley P. Fisher, Esq.; Juan Carlos A. Marquez, Esq.

(57) ABSTRACT

An engine unit case includes a housing configured to be assembled to a cylinder block of an engine, an oil pump provided at the housing, and a pressure adjusting mechanism for adjusting discharge pressure of the oil pump. The housing is unitarily formed with a pump chamber of the oil pump and a body of the pressure adjusting mechanism.

13 Claims, 3 Drawing Sheets

ENGINE UNIT CASE

CROSS REFERENCE TO RELATED APPLICATIONS

This application is based on and claims priority under 35 U.S.C. §119 with respect to Japanese Patent Application No. 2003-361014 filed on Oct. 21, 2003, the entire content of which is incorporated herein by reference.

FIELD OF THE INVENTION

The present invention relates to an engine unit case. More particularly, the present invention pertains to an engine unit case including a regulator valve for adjusting discharge pressure of an oil pump.

BACKGROUND

Engines include a cylinder head, a cylinder block, a crankcase, and an oil pan. With the foregoing construction, the crankcase serves as an engine unit case. Engines may include the cylinder head, the cylinder block, the crankcase, an upper oil pan, and a lower oil pan. With this construction, the crankcase and the upper oil pan serve as the engine unit case.

The engine unit case includes an oil pump for pressure feeding the oil to each portion in the engine for the lubrication and the cooling, and a regulator valve for adjusting the discharge pressure from the oil pump. An layout of the oil pump, the regulator valve, and oil paths (oil ports) in communication with the oil pump and the regulator valve impacts on reducing the size, reducing the weight, reducing the number of parts, and simplifying the machining and assembling of the engine unit case.

In case the regulator valve is assembled to the engine unit case, the relief oil discharged from the regulator valve drops in the oil pan provided at the bottom of the engine unit case. The oil hits the surface of the oil in the oil pan to generate the foam at the oil surface. With the foregoing construction, the air is likely to be mixed in the oil, which declines the lubrication performance at each portion of the engine.

In case the regulator valve is assembled to the engine unit case with a tightening means, it is required to provide an oil sealing member and a tightening member, or the like, at the fitting plane on the engine unit case for assembling the regulator valve. In other words, the construction of the engine unit case is complicated and the number of the parts increases. Further, because the regulator valve is projected from the fitting plane, the regulator valve is likely to be affected by the engine vibration, thus it is required to improve the vibration resistance thereof. In order to increase the vibration resistance performance, it is required to increase the thickness of the wall around the fitting plane or to provide a reinforcement rib for improving the fitting rigidity, which increases the weight of the engine unit case, and thus to increase the weight of the engine per se.

JPH05(1993)-10721U discloses the construction that an oil pipe is connected to an oil discharge port of the regulator valve so that the relief oil is directly returned to the oil pan in order to prevent the air mixture in the oil. However, with the foregoing construction, the number of parts for the engine per se is increased. JPH08(1996)-484Y2 discloses the construction for covering the surroundings of the discharge port of the relief oil of the regulator valve with a division wall provided either at the engine block (i.e., crankcase) or the oil pan. Although the air mixture in the oil can be avoided to some extent, the air mixture cannot be completely prevented because the foregoing structure is the construction for discharging the relief oil from the regulator valve to the external space. JPH10(1998)-141039A discloses the construction that includes the regulator valve positioned between mating faces of the engine block and the oil pan, and the relief oil is directly returned to a suction passage of the oil pump without being through the external space. The foregoing construction requires the complicated oil path (port) for both the engine block and the oil pan and complicated oil-sealing member at joining surfaces between the engine block and the port and between the oil pan and the port.

A need thus exists for an engine unit case, which prevents the air mixture in a relief oil discharged from a regulator valve.

SUMMARY OF THE INVENTION

In light of the foregoing, the present invention provides an engine unit case, which includes a housing configured to be assembled to a cylinder block of an engine, an oil pump provided at the housing, and a pressure adjusting mechanism for adjusting discharge pressure of the oil pump. The housing is unitarily formed with a pump chamber of the oil pump and a body of the pressure adjusting mechanism.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
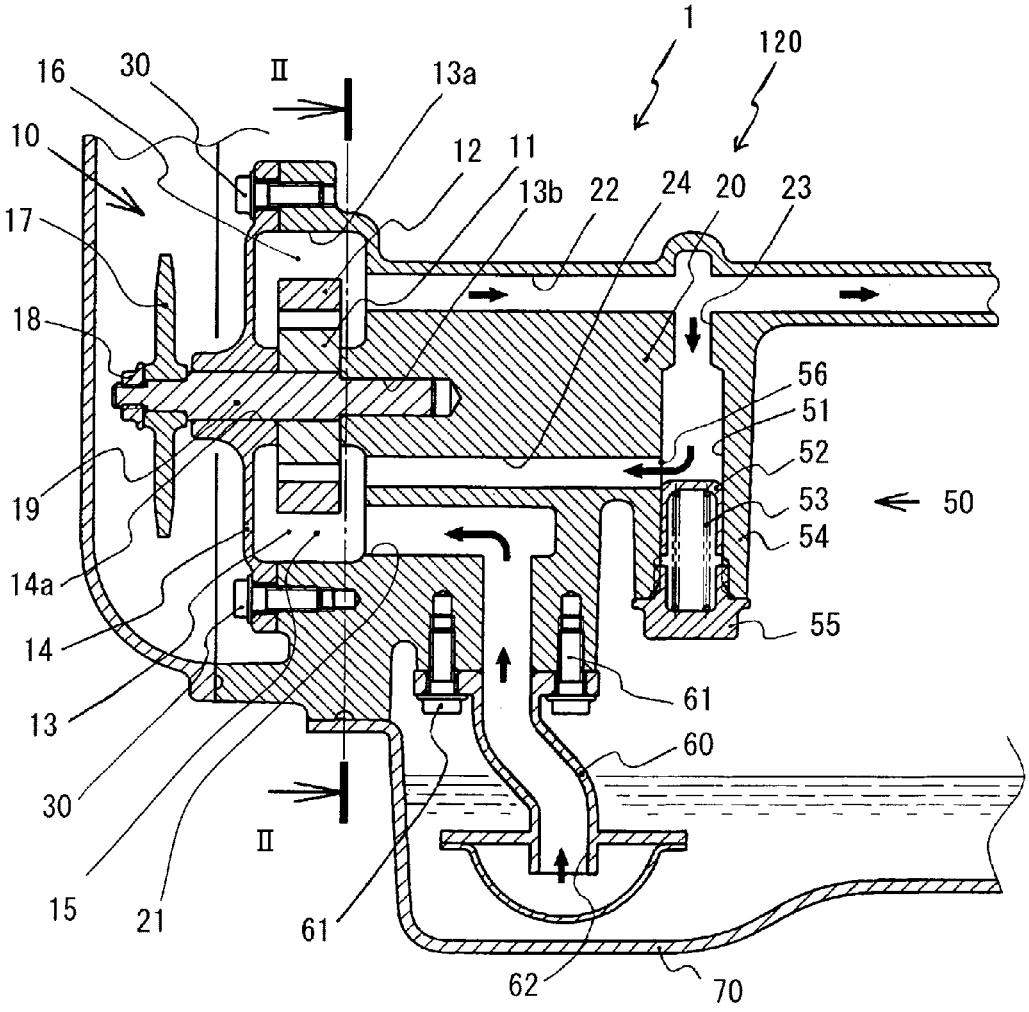
FIG. 1 is a longitudinal cross-sectional view of a housing 20 including a regulator valve 50 and an oil pump 10.

One embodiment of the present invention will be explained with reference to the illustrations of the drawing figures as follows.

Figure 3:
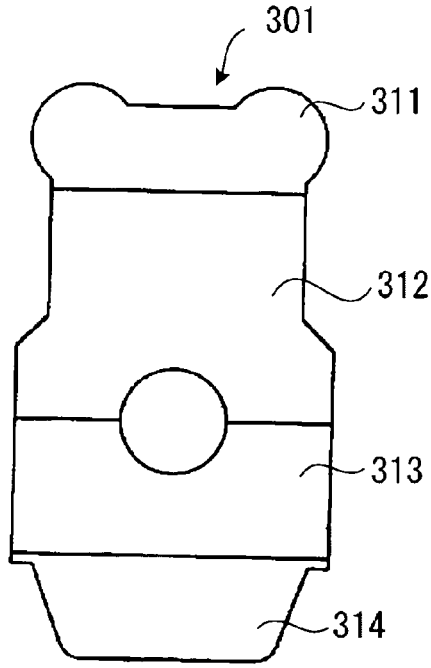
FIG. 3 is a schematic view of an engine 301 including a cylinder head 311, a cylinder block 312, a crankcase 313, and an oil pan 314, wherein the crankcase 313 corresponds to the engine unit case 120.
Figure 4:
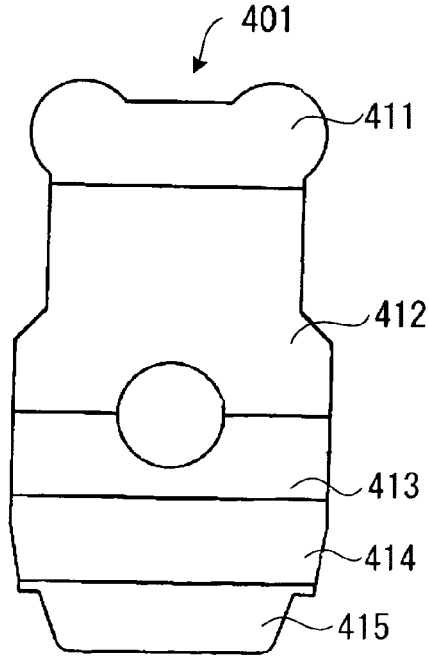
FIG. 4 a schematic view of an engine 401 including a cylinder head 411, a cylinder block 412, a crankcase 413, an upper oil pan 414, and a lower oil pan 415, wherein the crankcase 413 and the upper oil pan 414 corresponds to the engine unit case 120.

As shown in FIG. 3, an engine 301 includes a cylinder head 311, a cylinder block 312, a crankcase 313, and an oil pan 314. The crankcase 313 serves as an engine unit case 120 (shown in FIG. 1). As shown in FIG. 4, an engine 401 includes a cylinder head 411, a cylinder block 412, a crankcase 413, an upper oil pan 414, and a lower oil pan 415. The crankcase 413 and the upper oil pan 414 serves as the engine unit case 120. In other words, in case of the embodiment as shown in FIG. 4, the construction of the present invention can be applied to the both crankcase 413 and the upper oil pan 414.

Figure 2:
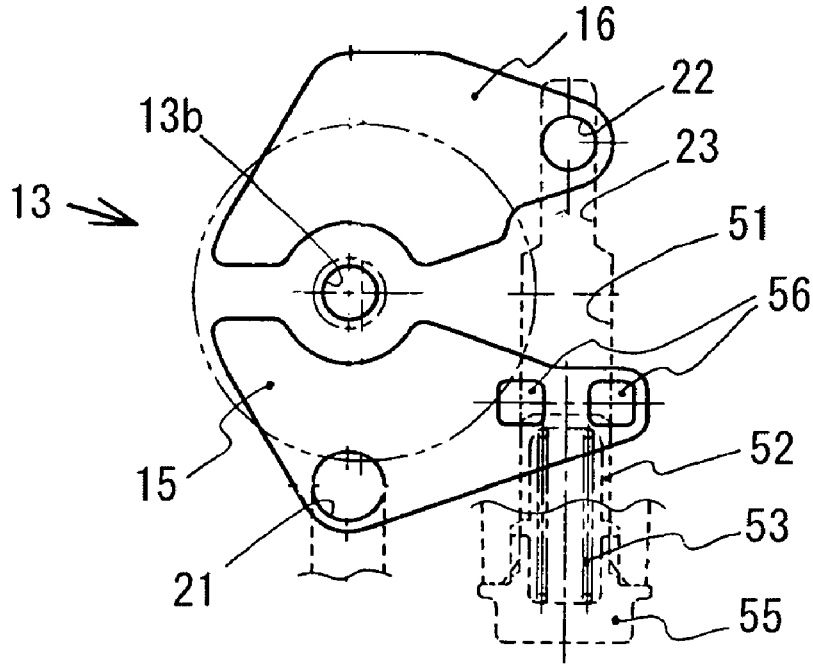
FIG. 2 is a cross-sectional view taken on line II—II of FIG. 1.

A housing 20 of the engine unit case 120 assembled with an oil pump 10, as shown in FIGS. 1–2, is provided at the bottom of the cylinder block 312, 412 of the engine 1 (301, 401). A pump chamber 13 accommodating a drive rotor 11 and a driven rotor 12 of the oil pump 10 is positioned at front end side (i.e., left side of FIG. 1) of the housing 20. The pump chamber 13 is defined by a concave portion 13*a* unitarily formed at the front end of the housing 20, and a cover 14 fixed to the housing 20 via bolts 30 for covering the concave portion 13*a*.

The pump chamber 13 includes a suction port 15 for sucking the oil and a discharge port 16 for discharging the oil. The suction port 15 is in communication with a suction passage 21 for sucking the oil reserved in an oil pan 70 (314, 415) provided at the bottom portion of the engine via an oil strainer 60. The suction passage 21 is arranged in parallel with a back and forth direction of the engine 1. The discharge port 16 is in communication with a discharge passage 22 for feeding the oil to portions of the engine 1. The discharge passage 22 is arranged in parallel with the back and forth direction of the engine 1. An introducing passage 23 configured to be introduced with the hydraulic pressure (i.e., discharge pressure) of the oil flowing in the discharge passage 22 is formed at a portion of the discharge passage 22. The introducing passage 23 is arranged in parallel with the top-bottom direction of the engine 1. A cylinder 51 is formed at a first end (i.e., bottom side of FIG. 1) of the introducing passage 23. The cylinder 51 accommodates a valve (i.e., serving as a relief valve) 52 configured to start opening when the hydraulic pressure reaches a predetermined hydraulic pressure (i.e., discharge pressure) of the oil flowing in the discharge passage 22 for controlling the discharge pressure approximately at a predetermined pressure. The cylinder 51 is arranged in parallel with the top-bottom direction of the engine 1. A body 54 including the cylinder 51 is unitarily formed with the housing 20. Accordingly, the tightening member for the regulator valve 50 serving as the pressure adjusting mechanism and the sealing member at the fitting plane are not required, and tightening defects and sealing defects can be prevented. Further, the influence of the engine vibration can be reduced and it is not required to increase the thickness of the wall at the fitting plane and to provide the reinforcement rib in order to increase the installation rigidity. Two relief holes 56 are formed on the lateral surface of the cylinder 51 for establishing the communication between the introducing passage 23 and a leading passage (relief passage) 24 upon the opening of the valve 52. Each relief hole 56 is in communication with the suction port 15 via the leading passage (relief passage) 24. The leading passage 24 is arranged in parallel with the back and forth direction of the engine 1. The cylinder 51 is arranged vertical to the discharge passage 22 and the leading passage 24 respectively. The leading passage 24 is in communication with the suction port 15 and arranged in parallel with the suction passage 21. The cylinder 51 accommodates the valve 52 opening and closing to control the communication between the introducing passage 23 and the leading passage 24 and a spring 53 for biasing the valve 52 to close the introducing passage 23. A plug 55 is capped on a first end of the cylinder 51 and a first end of the spring is engaged at the first end of the cylinder 51. The regulator valve 50 includes the cylinder 51, the valve 52, the spring 53, the body 54, and the plug 55. Thus, each shaft center of the regulator valve 50, the leading passage 24 (i.e., the relief passage), the suction passage 21 of the oil pump, and the discharge passage 22 of the oil pump is arranged either in parallel with the top-bottom direction of the engine 1 or the back and forth direction of the engine 1. Accordingly the machining and the assembling direction can be arranged either in the back and forth direction or the top-bottom direction of the engine 1, which simplifies the machining process and the assembling process.

The oil pump 10 includes a pump rotor having the drive rotor 11 fitted into a shaft 19 and the driven rotor 12 driven by the drive rotor 11. An intermediate portion of the shaft 19 is slidably supported by a penetration hole 14*a* formed at the cover 14. A sprocket 17 for transmitting the rotational driving force from the driving shaft of the engine 1 is fixed at a first end (i.e., left side of FIG. 1) of the shaft 19 via a nut 18. A second end side of the shaft 19 is rotatably supported by a bearing hole 13*b* opening to the concave portion 13*a*. By the geared rotation between the drive rotor 11 and the driven rotor 12, the oil is sucked from the suction port 15 to be discharged to the discharge port 16.

The oil pan 70 for reserving the oil is provided at the bottom of the housing 20. A suction port 62 is positioned under the hydraulic surface of the reserved oil, and the oil strainer 60 is arranged to be in communication with the suction passage 21 in the oil pan 70. The oil strainer 60 is fixed to the housing 20 via the bolts 61, 61.

The operation of the embodiment of the present invention will be explained as follows. Upon the transmission of the rotational driving force from the driving shaft of the engine to the shaft 19 via the sprocket 17, the drive rotor 11 unitarily formed with the shaft 19 rotates. The drive rotor 11 rotates together with the driven rotor 12 to suck the oil reserved in the oil pan 70 to reach the suction port 15 via the oil strainer 60 and the suction passage 21. The sucked oil is pressurized by the drive rotor 11 and the driven rotor 12 to be fed to the portion to be supplied via the discharge port 16 and the discharge passage 22. In this case, as shown in FIG. 1, when the discharge pressure of the oil flown in the discharge passage 22 reaches the predetermined pressure, the valve 52 moves against the biasing force of the spring 53. As a result, the introducing passage 23 and the leading passage 24 assumes to be in communication with the suction port 15 via the cylinder 51 and the relief holes 56. Thus, the excessive oil having the hydraulic pressure greater than the predetermined pressure flows into the suction port 15 and does not directly return to the oil pan 70. Accordingly, the excessive oil does not hit the oil surface of the oil reserved in the oil pan 70, and the foaming on the oil surface is not generated, which prevents the air mixture in the oil to ensure the lubrication of the engine.

Although an inscribing gear type oil pump is applied in the foregoing embodiment, other types of oil pump such as a circumscribing gear type oil pump, or, the like, may be applied.

Although the oil strainer 60 is provided as a separate part from the engine unit case 120 and is connected to the housing 20 in the foregoing embodiment, the oil strainer may be unitarily formed with the housing 20.

According to the embodiment of the present invention, because the body of the pressure adjusting mechanism is unitarily formed with the housing of the engine unit case, the pressure adjusting mechanism tightening member and the sealing member at the fitting plane are not necessary, which prevents the tightening defect and the sealing defect. In addition, the influence by the engine vibration can be reduced, and it is not necessary to increase the wall thickness at the installing portion and to provide the reinforcement rib in order to increase the fitting rigidity. Thus, the number of the parts can be reduced, the machining and the assembling can be simplified, and the weight and the size of the engine unit case can be reduced.

According to the embodiment of the present invention, because the relief passage of the pressure adjusting mechanism directly opens to and is in communication with the suction port of the pump chamber, the oil relieved from the pressure adjusting mechanism is directly returned to the suction port of the oil pump. Thus, the foaming on the oil caused by the relieved oil hitting the oil surface of the oil reserved in the oil pan can be securely prevented. Further, because the relief passage serves as the rib between the engine unit case and the pressure adjusting mechanism, the fitting rigidity of the pressure adjusting mechanism can be increased.

The principles, preferred embodiment and mode of operation of the present invention have been described in the foregoing specification. However, the invention which is intended to be protected is not to be construed as limited to the particular embodiment disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. An engine unit case, comprising:

a housing configured to be assembled to a cylinder block of an engine;

an oil pump provided at the housing; and a pressure adjusting mechanism for adjusting discharge pressure of the oil pump, wherein the pressure adjusting mechanism includes a relief passage in communication with the oil pump, the housing is unitarily formed with a pump chamber of the oil pump and a body of the pressure adjusting mechanism, the housing is unitarily formed with a suction passage and a discharge passage of the oil pump, the pressure adjusting mechanism includes a relief valve provided at a cylinder arranged in parallel with a top-bottom direction of the housing, and the cylinder is arranged to be vertical to the discharge passage and the relief passage.

2. An engine unit case, comprising:

a housing configured to be assembled to a cylinder block of an engine;

an oil pump provided at the housing; and a pressure adjusting mechanism for adjusting discharge pressure of the oil pump, wherein the housing is unitarily formed with a pump chamber of the oil pump and a body of the pressure adjusting mechanism, the pressure adjusting mechanism includes a relief valve provided at a cylinder arranged in parallel with a top-bottom direction of the housing, and the cylinder is arranged to be vertical to a discharge passage of the oil pump and a relief passage of the pressure adjusting mechanism.

3. An engine unit case, comprising:

a housing configured to be assembled to a cylinder block of an engine;

an oil pump provided at the housing; and a pressure adjusting mechanism for adjusting discharge pressure of the oil pump, wherein the pressure adjusting mechanism includes a relief passage in communication with the oil pump, the housing is unitarily formed with a pump chamber of the oil pump and a body of the pressure adjusting mechanism, the relief passage is directly in communication with a suction port of the pump chamber, and the housing is unitarily formed with a suction passage and a discharge passage of the oil pump.

4. The engine unit case according to claim 3, wherein at least part of the suction passage is arranged to be in parallel with a top-bottom direction of the housing.

5. The engine unit case according to claim 3, wherein at least part of the discharge passage and part of the relief passage are arranged in parallel with a back and forth direction of the housing.

6. The engine unit case according to claim 3, wherein the housing is provided with an oil pan of the engine; and a first end of the suction passage opens below an oil surface in the oil pan.

7. The engine unit case according to claim 3, wherein the pressure adjusting mechanism includes a relief valve provided at a cylinder arranged in parallel with a top-bottom direction of the housing.

8. The engine unit case according to claim 3, wherein the housing includes a cover for defining the pump chamber; and wherein a shaft of the oil pump is rotatably supported by the housing and the cover.

9. The engine unit ease according to claim 3, wherein at least part of the suction passage is arranged to be in parallel with a back and forth direction of the housing.

10. The engine unit case according to claim 9, wherein at least part of the suction passage is arranged to be in parallel with a top-bottom direction of the housing.

11. The engine unit case according to claim 3, wherein the pump chamber is formed with a suction port and a discharge port; and the relief passage and the suction passage are arranged in parallel with each other to be in communication with the suction port.

12. The engine unit case according to claim 11, wherein at least part of the suction passage is arranged to be in parallel with a back and forth direction of the housing.

13. The engine unit case according to claim 11, wherein at least part of the suction passage is arranged to be in parallel with a top-bottom direction of the housing.

* * * * *